United States Patent [19]

Hager et al.

[11] Patent Number: 4,467,739

[45] Date of Patent: Aug. 28, 1984

[54] SEAMED MATERIAL EDGE GUIDE FOR A SEWING MACHINE

[75] Inventors: Walter Hager, Kaiserslautern; Kurt Petry, Stelzenberg, both of Fed. Rep. of Germany

[73] Assignee: Pfaff Industriemaschinen GmbH, Fed. Rep. of Germany

[21] Appl. No.: 454,050

[22] Filed: Dec. 28, 1982

[30] Foreign Application Priority Data

Jan. 25, 1982 [DE] Fed. Rep. of Germany ..... 3206682

[51] Int. Cl.[3] ..... D05B 35/02

[52] U.S. Cl. ..... 112/153; 112/235

[58] Field of Search ..... 112/153, 150, 152, 235, 112/136, 217

[56] References Cited

U.S. PATENT DOCUMENTS

| | | | |
|---|---|---|---|
| 2,478,032 | 8/1949 | Wallsh | 112/235 X |
| 2,588,886 | 3/1952 | Schwartz | 112/136 |
| 2,781,008 | 2/1957 | Nielsen | 112/235 X |

FOREIGN PATENT DOCUMENTS

| | | | |
|---|---|---|---|
| 145196 | 1/1950 | Australia | 112/152 |

*Primary Examiner*—Werner H. Schroeder
*Assistant Examiner*—Andrew Falik
*Attorney, Agent, or Firm*—McGlew and Tuttle

[57] ABSTRACT

A sewing machine for making edge-parallel shaping seams in multiple layer articles such as shirt collars comprises a reciprocating needle for sewing through the multiple layers of a workpiece such as a collar which has a plurality of edges disposed at angles to each other. The construction includes a guide fence having a guide edge extending alongside the needle. The material is guided against the guide edge. A feeder engages the workpiece from below a presser foot which is biased against the needle in a working position. The presser foot has an upwardly extending infeed end and a hold-down member in the form of a strip element. It is adjustably supported above the workpiece and includes a front edge which is engaged downwardly on the workpiece and extends into the infeed end of the presser foot.

5 Claims, 5 Drawing Figures

SEAMED MATERIAL EDGE GUIDE FOR A SEWING MACHINE

FIELD AND BACKGROUND OF THE INVENTION

This invention relates in general to the construction of sewing machines and in particular to a new and useful sewing machine for making edge parallel shaping seams.

A sewing machine of this type is known from U.S. Pat. No. 4,181,085 (German OS No. 28 33 634) for sewing the outer corner seam in shirt collars. In order to be able to hold the components of the shirt collar, congruently and precisely by the outer and/or corner seam, the components are placed one on top of the other, and their eventual inner sides are provided with a stiffening insert. They are then sewn together with a joining seam on three sides and turned. It is conventional to iron the collars flat on shaping plates by subjecting them to pressure and heat. The plates conform to the outside contour of the shirt collar. A machine for doing this is known from U.S. Pat. No. 4,213,547 (German OS No. 29 39 728). Since the processing time required for a satisfactory ironing for an article of clothing on these machines is very much greater than that required on modern sewing machines for making the outer corner seam, either longer downtimes for the rather expensive sewing station must be accepted, or a setup of this kind must be forgotten when the work station consists of one machine for turning and ironing and a sewing part for making the outer corner seam on shirt collars.

U.S. Pat. No. 2,311,407 teaches the use of a hem edge guide as an aid in sewing a shirt collar, which is composed of an outer collar and a neck band, to the upper edge of the body of a shirt. The guide consists of a pleating and guide fence under spring action, with a horizontal turndown flange, pivotably mounted on an extension mounted on the material pressure bar of the sewing machine so that it can swivel into a working or a resting position. The turndown flange is provided with a leading edge which is directed at an angle to the feed direction of the material. The edge, in the working position, engages the inner free edge of the lower layer of material of the neck band, which is sewn together with a stiffening insert to the upper edge of the body of the shirt, and folded inward through 180° so that the edge is guided in a flattened position to the point where the stitches are made. At this location the uppermost layer of material in the neck band, together with the lower layer of material and the stiffening insert, is sewn by a second seam to the body of the shirt. This eliminates pre-ironing.

This known pleating and guide fence, however, can only be moved into the operating position when the initial area of the neck band has been appropriately turned and sewn by hand because the side edge of the neck band is closed. Before reaching the end of the seam, the pleating fence must be swung back from the working position to the resting position because of the closed side edge of the neck band, and the material must be turned over by hand for the remainder of the seam.

Basically, the known pleating and guide fence for turning the inner free edges next to the first joining seam of the material in the turned collar can be used, but its use in making the outer corner seam on the collar is made impossible by the fact that turning the collar around the corner seams with the sewing machine stopped and with the guide fence fitted is just as impossible as turning over those areas which had to be processed without the pleating fence. Therefore, there is no way in which ironing of the turned collar can be avoided.

SUMMARY OF THE INVENTION

The present invention is disclosed for improving the operation of a machine like that described at the outset. The solution of the invention is designed to solve the problem of adjusting the processing time, especially the ironing time in the machine for turning and ironing, to the sewing time, i.e. to shorten it. The arrangement includes other measures at the sewing station without affecting the sewing time, to correct the resultant poorer ironing result produced by a partial recrumpling of the material because the accumulations of material have been turned, particularly in the area of the edge zones which are sewn together.

In accordance with the invention, a sewing machine is provided which has a reciprocating needle for sewing a multi-layer workpiece such as a collar which has a plurality of edges disposed at an angle to each other. The construction includes a guide fence which has a guide edge, corresponding to the circumferential shape for an edge parallel seam which extends alongside the needle. The material is guided against this guide edge. Feed means engage with the workpiece for advancing it the needle. A presser foot is engageable with the workpiece over the feed means and has an infeed end extending upwardly away from the workpiece. A holddown member overlies the workpiece and has a portion extending into the infeed end of the presser foot and engages the workpiece and guides the layers into a position parallel to the guide edge. A holddown is advantageously supported for upward and downward movement to engage or disengage the workpiece. The holddown is advantageously made of an elastic spring sheet steel and is fixed adjacent the end which extends away from the presser foot and is connected with a positioning device in the form of a fluid pressure cylinder for adjusting its position.

The construction of the invention makes it possible to effect the unimpeded insertion and removal of the workpiece material as well as permitting turning of the material at the seam corners.

An object of the invention is to provide an improved sewing machine having a construction including a holddown operating with a presser foot and feed element effecting the edge parallel seeaing of a multilayer workpiece.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
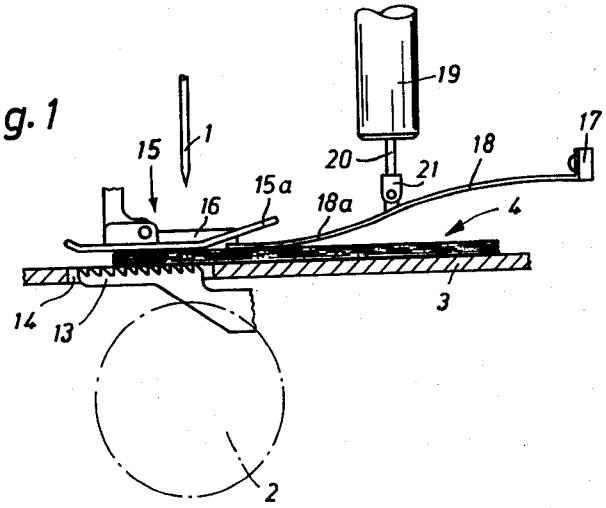
FIG. 1 is a front elevational view of an segment of the stitch forming area of the sewing machine with material inserted and with the holddown according to the invention in its operating position.

Referring to the drawings in particular the invention embodied therein, comprises a sewing machine having a reciprocating needle generally designated 1, for sewing a multi-layer workpiece 4 such as a collar which has a plurality of edges 10, 11 and 12 disposed an angles to each other. In accordance with the invention, a guide fence 16 has a guide edge 16*a* extending alongside the needle against which edge the material is guided. Feed means in the form of a feed dog 13 movable in a substantially rectangular pattern cooperates to advance the workpiece 4 into association with the needle and the gripper 2 which cooperates therewith to effect the sewing of a seam 9. A presser foot 15 is biased downwardly by means (not shown) and it has an infeed end 15*a* which extends upwardly away from the workpiece 4. A holddown 18 overlies the workpiece 4 and has a portion 18*a* which extends under the infeed end 15*a* of the presser foot 15. The holddown 18 is mounted on a forked end 21 of a piston rod 20 which reciprocates in respect to an associated fluid pressure cylinder 19. The fluid pressure cylinder 19 is connected to suitable means for moving the piston rod 20 to affect positioning of the holddown 18 in respect to the workpiece 4 and in respect to the presser foot 15.

Figure 4:
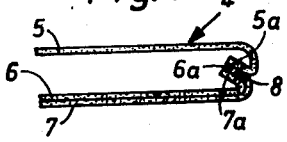
FIG. 4 is a section taken along line IV—IV of FIG. 3 on an enlarged scale, with the distance of the layers of material from one another being shown much greater than in reality.

Needle 1, which is fastened to the needle bar of the sewing machine and is movable up and down operates to form stitches, together with gripper 2 as indicated in FIG. 1 by the dot-dashed lines. The material to be sewn, resting on stitching plate 3 and consisting, in the embodiment shown in FIGS. 4 and 5, of a shirt collar 4 is composed of an upper layer of material 5, a stiffening insert 6, and a lower layer of material 7. The material layers 5, 6 and 7 are sewn together by a joining seam 8 made along three edges and the layers are turned and ironed on a turning and ironing machine. To form the outer corner seam 9, which runs parallel to the three outside edges 10,11 and 12 the shirt collar caused by feed movements by feeder 13, which executes a rectangular motion, and rotary movements at each corner about inserted needle 1. The rotary movements are effected by a material turning device at the seam corners with the sewing machine stopped in the needle down position. Feeder 13 projects upward through a slot 14 in stitching plate 3 to feed the material forward. The guide fence 16 which is adjustable laterally to needle 1 serves to guide shirt collar 4 along its outer edges 10, 11 and 12.

The end of a holddown 18 which is made of sheet spring steel and is spaced away from material presser foot 15 is attached to a support 17 mounted on the housing. Forked head 21, is connected approximately centrally between the fixed and free ends of the holddown 18 with a peg on the holddown 18 which projects into the opening of the fork and is not shown.

Operation is as follows:

A shirt collar which is joined on three sides by joining seam 8, consisting of the three layers 5,6, and 7, which is turned and pulled onto the shaping plates of the turning and ironing machine known from U.S. Pat. No. 4,213,547 is subjected to pressure and heat treatment on the shaping plates for approximately the duration of the sewing time to produce outer corner seam 9. The ironing results approximately to the state shown in FIG. 4 in which the free edges 5*a*, 6*a* and 7*a* of material layers 5, 6 and 7, in addition to joining seam 8, having not yet been completely flattened through 180° inward since the ironing time corresponding to the sewing time is not sufficient for this, but project upward at an angle of approximately 30° to 45°. Shirt collar 4 has therefore undergone only a preshaping. Surprisingly, tests have shown that this preshaping, which can be achieved in a much shorter time than with complete flat ironing, is completely adequate for reliable processing of shirt collars when making outer corner seam 9 which also includes free edges 5*a*, 6*a*and 7*a*, if presser foot 18, which is located on one material feed side of pressure bar 15 is used to press inside free edges 5*a*, 6*a* and 7*a* flat into a position parallel to the material support surface immediately in front of pressure bar foot 15.

Figure 5:
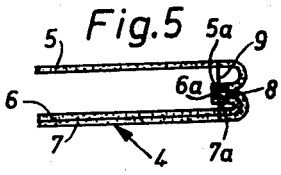
FIG. 5 is a section taken along line V—V in FIG. 3, likewise enlarged as in FIG. 4.
Figure 2:
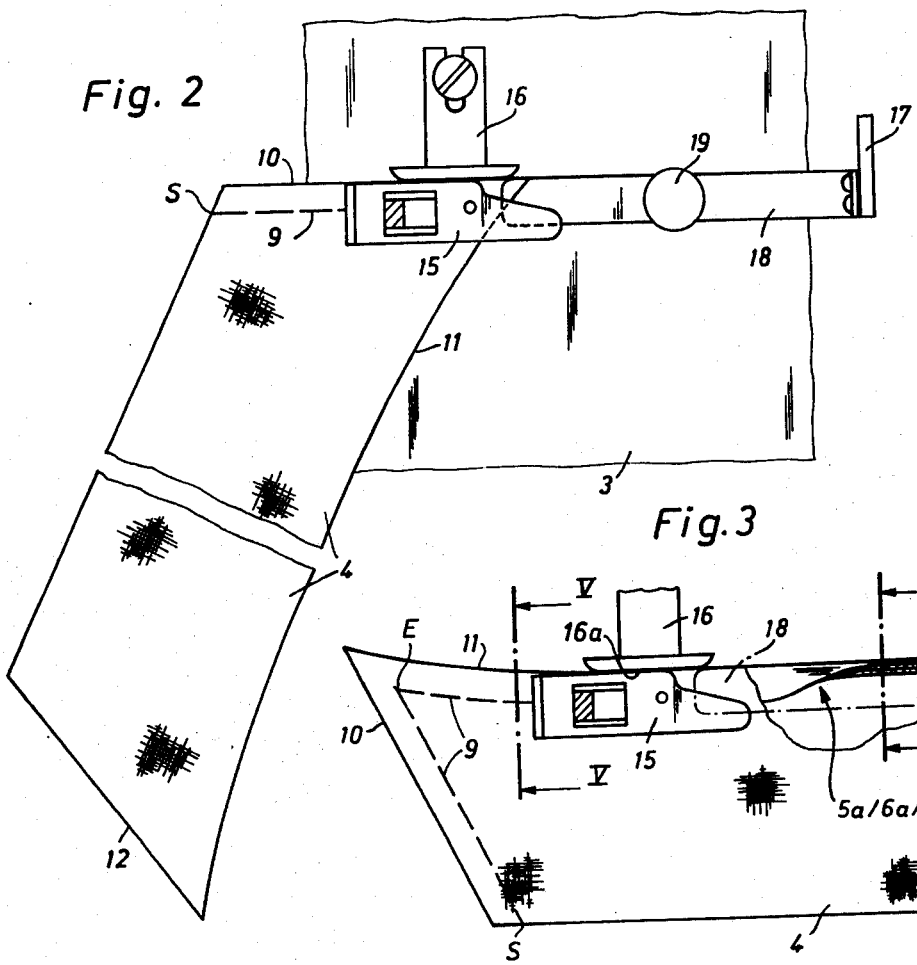
FIG. 2 is a top view of the segment of the stitch-forming area shown in FIG. 1 and the holddown with a shirt collar, partially shown, at the end of the first seam section of the outer corner seam.
Figure 3:
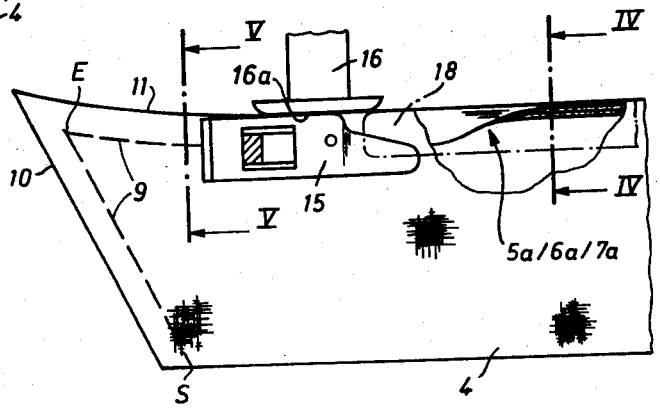
FIG. 3 is a view similar to FIG. 2, in which the upper layer of material to be sewn is shown partially cut away and the shirt collar has been turned to correspond to the new sewing direction and a portion of the additional path of the outer corner seam has been sewn.

To create the outer corner seam 9, shirt collar 4, stretched tight, is inserted beneath lifted holddown 18 and raised presser foot 15 so that the position of the start of the seam denoted by the letter S in FIGS. 2 and 3 is beneath needle 1 and outer edge 10 of shirt collar 4 rests against guide fence 16. When presser foot 15 comes down together with holddown 18, inside free edges 5*a*, 6*a* and 7*a* of layers 5,6 and 7 of the material of shirt collar 4 are pressed flat into the final shape as shown in FIG. 5. Then the sewing machine is turned on and the first partial portion of outer corner seam 9 which runs from starting point S to corner stitch E is sewn. Inside edges 5*a*, 6*a* and 7*a* are provided with outer corner seam 9 and are sewn together with layers 5,6 and 7. During sewing, holddown 18 continues to hold free edges 5*a*, 6*a* and 7*a* continuously flat as well as the layers of material 5,6 and 7 and in the boundary area next to outer edges 10, 11 and 12 of shirt collar 4 on the feed side of presser foot 15.

At the first seam corner E, the sewing machine is stopped with the needle down, presser foot 15 and holddown 18 are raised, and shirt collar 4 is turned around needle 1 until the outer edge 11 abuts guide fence 16. Then presser foot 15 and holddown 18 are lowered again and the sewing machine is turned on in order to sew corner seam 9 which runs parallel to outer edge 11 of shirt collar 4, up to the partial portion which extends up to the second seam corner of corner seam 9 which includes the edges 5*a*, 6*a* and 7*a* which are continuously pressed flat by the holddown. As with the first seam corner, the sewing machine is stopped at the second seam corner with the needle down, presser foot 15 and holddown 18 are raised, and shirt collar 4 is rotated around needle 1 until outer edge 12 rests against guide fence 16. After presser foot 15 and holddown 18 are lowered, the remaining partial portion of corner seam 9 which runs parallel to outer edge 12 is sewn. At the end of the seam, the sewing machine is stopped. After the thread has been cut and presser foot 15 and holddown 18 have been raised, the finished shirt collar 4 can be removed and the sewing machine loaded with a new pre-ironed shirt collar.

While a specific embodiment of the invention has been shown and described in detail to illustrate the application of the principles of the invention, it will be understood that the invention may be embodied otherwise without departing from such principles.

What is claimed is:

1. A sewing machine have a reciprocating needle for sewing a multi-layer workpiece such as a collar which has a plurality of edges disposed to angles to each other, comprising a guide fence having a guide edge corresponding to the circumferential shape of the workpiece for an edge parallel seam extending alongside the needle and against which guide edge the material is guided, feed means engageable with the workpiece for advancing it past the needle, a presser foot engageable with the workpiece over said feed means and having an infeed end extending upwardly away from the workpiece, and a holddown overlying the workpiece and having a portion extending into the infeed end of said presser foot and engageable with the workpiece and guiding the layers of the workpiece into a position parallel to said guide edge.

2. A sewing machine according to claim 1, including means engageable with said holddown for moving it toward and away from the workpiece into and out of a working position.

3. A sewing machine according to claim 1, wherein said holddown comprises an elastic spring sheet steel, drive means engageable with said sheet steel at a spaced location from said portion of said holddown which engages with the workpiece, said drive means being movable to raise and lower said holddown relative to the workpiece.

4. A sewing machine according to claim 3, wherein said means engageable with said workpiece includes a piston rod member pivotally connected to said holddown intermediate the length thereof, said holddown having one end engageable with the workpiece and an opposite end connected to a support.

5. A sewing machine according to claim 1, wherein said holddown includes a flattened portion engaging on the workpiece and effecting an ironing down thereof to press the inner edges of the workpiece flat to bring them into a position parallel to said guide edge.

* * * * *